US007360766B2

(12) United States Patent
Wirth

(10) Patent No.: US 7,360,766 B2
(45) **Date of Patent: *Apr. 22, 2008**

(54) METHOD FOR PLAYING CASINO POKER GAME

(76) Inventor: John E. Wirth, 10808 Depot - P.O. Box 400, Worth, IL (US) 60482

( * ) Notice: Subject to any disclaimer, the term of this patent is extended or adjusted under 35 U.S.C. 154(b) by 171 days.

This patent is subject to a terminal disclaimer.

(21) Appl. No.: 11/208,236

(22) Filed: Aug. 18, 2005

(65) Prior Publication Data

US 2005/0275166 A1 Dec. 15, 2005

Related U.S. Application Data

(63) Continuation-in-part of application No. 10/427,338, filed on May 1, 2003, now abandoned, which is a continuation-in-part of application No. 10/247,987, filed on Sep. 20, 2002, now Pat. No. 6,705,613.

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS 3,667,757 A 6/1972 Holmberg
4,836,553 A 6/1989 Suttle et al.
4,861,041 A 8/1989 Jones et al.
5,078,405 A 1/1992 Jones et al.
5,098,107 A 3/1992 Boylan et al.
5,154,429 A 10/1992 LeVasseur
5,437,462 A 8/1995 Breeding
5,489,101 A * 2/1996 Moody ..... 273/292
5,584,485 A 12/1996 Jones et al.
5,597,162 A 1/1997 Franklin
5,810,354 A 9/1998 Banyai
5,845,906 A 12/1998 Wirth
6,113,101 A 9/2000 Wirth
6,179,293 B1 1/2001 Hedman
6,467,771 B1 10/2002 deKeller
6,517,072 B1 * 2/2003 McInerney ..... 273/236
6,705,613 B1 3/2004 Wirth

* cited by examiner

*Primary Examiner*—Benjamin H Layno
(74) *Attorney, Agent, or Firm*—Marshall, Gerstein & Borun LLP

(57) ABSTRACT

A casino game, based on the rules of poker, wherein each player is dealt five cards, with an option to utilize a sixth card to improve the five-card hand. The players pay a percentage of their ante wager, e.g., 10% or 20%, for the right to use a sixth card, and the dealer pays a set fee, e.g., $0.50, $1.00, or $2.00 for the right to use a sixth card. The game provides a player with multiple opportunities to win: 1) head-to-head competition against the dealer, with the higher poker hand winning; 2) competition for a common pot among the players with the highest player-to-player poker hand winning the common pot on each deal and, optionally, a bonus payment for long-odds hands (e.g., straight or better). Because no player has an opportunity to increase his/her initial wager after the cards are dealt, the game proceeds rapidly.

16 Claims, 1 Drawing Sheet

METHOD FOR PLAYING CASINO POKER GAME

RELATED APPLICATIONS

This is a continuation-in-part of application Ser. No. 10/427,338, filed May 1, 2003 now abandoned which is a continuation-in-part of application Ser. No. 10/247,987, filed Sep. 20, 2002, now U.S. Pat. No. 6,705,613.

BACKGROUND OF THE INVENTION

In U.S. Pat. Nos. 5,845,906 and 6,113,101, the text of which is incorporated by reference herein, I described methods for playing wagering games which were based, in substantial part, on the rules of poker. As was the case with these earlier disclosures, the present invention relates generally to a playing card wagering game which is particularly applicable to a casino environment in which multiple players compete with themselves and with the house. The game in its variations can also be played in a home environment.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies, which are most difficult to meet since the casino should have an odds advantage that cannot be too great, or too small.

Wagering games, including wagering games for casino play with multiple wagering opportunities, are known. In addition to the above-mentioned patents, U.S. Pat. Nos. 4,861,041 and 5,078,405 (both to Jones et al) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al). Somewhat similarly, U.S. Pat. No. 3,667,757 (to Holmberg) discloses a board game and apparatus, including a way to allow the player to make a choice with respect to several different alternative types of game play and risk-bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

U.S. Pat. No. 5,437,462 (to Breeding) discloses a casino-type poker game wherein players are given an opportunity to withdraw at least a part of their bets before all the cards are dealt. The game employs at least one common card which can be used by all of the players.

It has been found that it is very difficult to meet the regulatory agency requirements for any casino poker game that includes 1) one wager (ante) for player vs. dealer; 2) a price or wager that each player pays to the casino for the players to utilize a sixth card, in addition to an originally dealt five card hand; and 3) another wager (player vs. player) that each player pays to a Players Pot that goes to the player having the highest poker hand on each deal. The casino poker game described herein provides for each of these features in a casino poker game that meets the requirements of casino regulatory agencies by requiring the casino or house (dealer) to pay a price, that is added to the Players Pot, for the dealer's use of a sixth card, and by setting the price for each player for utilization of the sixth card in the range of about 5% to about 50% of the player's ante wager, preferably about 10% to about 20% of the player's ante wager.

SUMMARY OF THE INVENTION

The present invention relates to a card game, in particular to a card game suitable for use in casinos, and to tables for playing the game. The game combines the concepts of draw poker with simultaneous play against a dealer (the house) and play against other players. In one embodiment, players who are dealt "premium hands" (as hereafter defined) can receive bonus payments, depending on the value of the hand, but in the preferred embodiment "premium hands" do not form part of this game. Because the players are not permitted to increase their wagers, the game moves rapidly.

The game follows the rules of stud poker, and a single, 52-card deck is used. Each player's poker hand is made from 5 dealt cards, with the right to use a sixth card, whether it is a common sixth card, or each player is dealt a separate sixth card, to improve the dealt hand if the player so elects and pays the house a percentage (less than 100%), of his ante wager for the privilege of using the sixth card. The dealer has the same option as other players, i.e., to make the best five-card hand from six cards; the dealer also pays a predetermined price, to a Players Pot, for the privilege of using the sixth card. Each player plays head-to-head against the dealer for one part of the wager (the ante wager), and against the other players for another part of the wager (the "common pot" or "Players Pot"). In the less preferred embodiment, a bonus or "premium hands payout" provides the players with an opportunity to win a multiple of their ante wagers.

Premium or bonus pots have become very popular with the gaming public. In one embodiment, this game incorporates a system for rewarding players having exceptional (statistically rare) hands, but unlike conventional games (e.g., Caribbean Stud) where players contribute to the makeup of that pot, this embodiment of the present game has a bonus system which does not require a direct contribution by the players.

In the less preferred embodiment, a player will receive a bonus or premium payment from the house—the amount of the bonus payment being based on the rarity of the hand. For example, if a first player has a hand containing three-of-a-kind, and a second player has a hand containing a straight flush (both hands higher than that of the dealer), the second player would receive a higher bonus payout than the first player. As the forgoing example illustrates, more than one player may receive a bonus payment in a given round.

The amount or cost of the right for a player to use the sixth card can be varied, and is based upon a percentage of the player's ante wager, e.g., 5% to 50% of the ante wager, preferably 10% or 20% of the player's ante wager. For example, if the ante wager is $10.00, the price for a player to utilize the sixth card would be $1.00 or $2.00 (10% or 20%). The dealer, on the other hand, would pay a set price to the Players Pot for the opportunity to utilize the sixth card, preferably $0.50 to $2.00, more preferably $0.50 or $1.00.

The game would proceed as follows. The dealer (house) operates from a table playing station which provides easy access to the players. In addition to the dealer, the game can be played by as many as six players around the table, each operating from a playing station which has a card playing area and a betting area. Each player's betting area contains at least two wager zones: a first or Ante zone, a second zone for wagers which form the "Players Pot" (p.p.) and a third zone for placing a payment, that is a predetermined percentage of his ante wager, e.g., 10%, for the right to use a sixth card, or common card (c.c.) if the player wishes to avail himself of this option. Each of the players stations also contains a region or zone where cards can be dealt.

The dealer's playing station is somewhat different than that of the players. In addition to a region or zone for placing the five cards dealt to the dealer, in a preferred embodiment, the dealer's playing station contains a marked area or zone for placement of a common card (c.c.) which can be utilized by any of the players, including the dealer. In the preferred embodiment, the common card will be turned sideways. In a preferred embodiment, the dealer's playing station also contains a region or zone for maintaining a common Players Pot.

In a preferred method, play would commence as follows: Each player would place two wagers: an ante in an Ante zone which can be from $5.00 to $25.00 in whole dollar amounts; and an additional $5.00 wager in a second, Players Pot zone (p.p.) which will form part of the Players Pot. Although these table limits could be varied at the option of the house (e.g., $10.00 to $50.00 ante, and $10.00 for the Players Pot), the amount which can be wagered in the Players Pot is a fixed sum, and the same for each player. Only the ante wager with the house can be varied, in whole-dollar amounts, and that wager only at the onset of play, before any cards have been dealt. In order to maintain the flow of play, there is no opportunity to raise any bet after the cards have been dealt. Since there is no qualifying hand by the dealer or minimum hand to open, all hands play and the Players Pot will be won each hand by the player with highest poker hand.

Five cards are dealt to each player, starting with a player adjacent to the dealer; the dealer being dealt last. The cards may be dealt from right-to-left or left-to-right. The cards are dealt one-at-a-time, unless a machine is used, in which case the cards may be dealt five-at-a-time. Individual players are permitted to play only one hand at a time.

At some point in the deal, the dealer places a single card in a "Common Card" zone region of the table. All cards—players', dealer's and the common card—are dealt face down.

The players look at their five cards and determine if they wish to fold, stand pat or utilize the sixth card or common card. A player desiring to fold surrenders his hand to the dealer and forfeits both of his original bets; the ante bet is collected by the dealer, and the bet in the Players Pot zone is retained for the player with the highest poker hand. If a player wishes to utilize the sixth card or common card, the player will place the predetermined percentage of his ante wager, preferably 10% or 20% of his ante wager, e.g., $0.50 or $1.00 in a designated, third or common card (c.c.) area on the table in front of his playing station. The fact that a bet appears in this third area is an indicator to the dealer that the player is entitled to use the sixth card. The dealer also decides if he wishes to utilize the sixth card. If the dealer decides to use the sixth card, he contributes a set amount, e.g., $0.50 to $2.00, preferably $0.50 or $1.00 to the Players Pot. While a house rake can be employed in the present game, statistical analysis has demonstrated that the present game will generate a profit to the house even if a rake is not taken. The fact that 100% of the Players Pot is distributed to the players provides additional attraction to the game.

The sixth or common card can be used to improve the players' and dealer's present five card hand but only five cards are used to make up a player's best hand. Upon completion of the hand, the players' extra card (c.c.) payments go to the house, and the dealer's cost for utilizing the extra card, which is added to the Players Pot if the dealer decides to use the sixth card, is paid each deal, to the player with the highest five card poker hand. Alternatively, and preferably, the dealer must pay for and be entitled to use, the sixth card, or common card, each deal.

The dealer does not participate in the Players Pot unless there is only one player at the table, at which time the dealer (like the player(s)) shall place the table minimum in the Players Pot. The player and dealer will then play head-to-head for both the ante wager and the Players Pot.

As will be described in greater detail below, the wager in the ante zone represents a bet between the player and the dealer. The wager in the player's second, or Players Pot, zone represents a bet with each of the remaining players, apart from the dealer. That is to say, except for an optional service charge or "rake" (described hereafter), the dealer is not eligible for any portion of the Players Pot.

Although the dealer does not normally participate as a player for the Players Pot, the house may be entitled to a portion of the Players Pot as a service charge or "rake". A commonly-used rake for casino card parlors is 5% of the pot. The 5% "rake" would be paid to the house upon each deal before the "Players Pot" is distributed to the winning player. These suggestions concerning the amount of the house "rake" are for illustration only, and variations could be made at the option of the house. Indeed, as described above, the present game will generate a profit to the house even if no rake is taken. It is contemplated that casinos may elect to forego a house rake in order to attract players to the game.

With respect to the bets placed at each player's "Players Pot" zone, these wagers could be gathered by the dealer and placed in the common Players Pot region on the table or left in front of the individual player at the option of the house. Preferably, the Players Pot wagers are left in front of each player using the sixth or common card to identify the players who have paid for the right to use the sixth or common card.

Once all players have looked at their cards and have decided whether to make their common card bets, the players place their cards face down on the table, and the dealer exposes his hand and the common card.

After the five cards dealt to the dealer have been exposed, the dealer exposes the common card. Irrespective of the result of this turn-over on the value of the dealer's hand, all dealer hands must play.

After the dealer's hand has been exposed, the dealer turns up each player's hand, starting from his left to right. The dealer pays an amount equal to the ante wager in the first betting zone to each player who has a higher poker hand than the dealer, and collects the ante bets from all of the players with lower hands than the dealer. In the event of a tied hand between player and dealer, the ante wager is a "push". All hands are left exposed for the dealer to determine the highest player poker hand and to distribute finds from the Players Pot to that player. If the highest poker hands are of equal value, the Players Pot would be split.

In an optional bonus embodiment, if the player's hand is both: 1) higher than the dealer's hand; and, 2) of the type which constitutes a "bonus" hand, then the player would receive a multiple of his bet. For example, if the player had anted $20, the dealer has a pair, and the player has two pairs, the player would receive his original $20 bet, plus $20 from the dealer. Given the same situation, but the player's hand comprising a full house, the player would receive his original $20 bet, plus $140 from the dealer (a 7:1 return in accordance with the following table). In those situations where a player and the dealer have hands of the same value, these hands result in a "push", and no money is exchanged between the player and the dealer. Alternatively, in this situation where dealer and player have tied hands, a win could go to a player or dealer who can utilize only the cards dealt (without using the sixth card) to achieve the best hand, if the other (player or dealer) requires the sixth card for his best hand.

Similarly, in those rare situations where two players have identical winning hands, the Players Pot is split between the two players.

One additional advantage of the present game is that it can be played by up to six players on a standard 76 inch black jack table and does not require a large amount of floor space in a casino operation.

As to the amount of the bonus embodiment, in the preferred method, the bonus payouts by the dealer would be based on the amount a player has anted. Suggested payouts based on this system are as follows:

| | |
|---|---|
| Three of a Kind | 2 to 1 |
| Straight | 3 to 1 |
| Flush | 5 to 1 |
| Full House | 7 to 1 |
| Four of a Kind | 20 to 1 |
| Straight Flush | 125 to 1 |
| Royal Flush | 250 to 1 |

Using the above table, and assuming that the player's hand is higher than that of the dealer, a player who has anted the minimum of $5.00 who holds a flush would be entitled to a payment of $25.00 from the dealer, plus return of the $5.00 ante bet.

The foregoing table of bonus payouts, in the bonus embodiment of this game, has been provided by way of example, only, and could be varied at the discretion of the house. In particular, the house might well decide to start the bonus payouts at hands comprising a straight or better.

The final stage of play involves head-to-head competition among the players. The wagers in this Players Pot zone, as well as any bet (Players Pot contribution) made by the dealer for the opportunity to utilize the sixth card, form a common, Players Pot. This Players Pot will be paid to the player who has the highest poker hand each round.

As noted above, the dealer does not normally participate in the Players Pot (apart from an optional house "rake" or when there is only one player at the table) except to contribute a set sum for the right to utilize the sixth card.

In summary, under the method described above, a player has two or three opportunities to win: 1) by having a higher poker hand in one-on-one play with the dealer (the ante wager); 2) by having the highest poker hand among all of the players at the table (the Players Pot); and 3) in a bonus embodiment, by having a "premium" or "bonus" hand (e.g., three-of-a-kind or better) which entitles the player to a premium payout from the house. Operation of the game can be further understood with reference to the description of apparatus for playing the game.

Finally, it should be possible to add a "progressive pot" option to the bonus embodiment of the present game. Progressive pots, which are familiar to participants in casino poker games, provide a player with an option of contributing a small wager (e.g., $1.00) for the opportunity to win a relatively large sum of money in the event the player holds a royal flush. The normal procedure with respect to this option is to allow funds to accumulate over a long period of time, and to award the accumulated value of the progressive pot (less expenses and an optional house rake) to any player who has such a hand. In straight poker, the odds of being dealt five cards comprising a royal flush are in the neighborhood of 650,000:1. While providing players an opportunity to use a sixth card will reduce these odds, somewhat, nonetheless, statistics would predict a payout of several hundred thousand to one, which could further enhance the allure of the game.

Although certain apparatus constructed in accordance with the teachings of the invention is described herein, the scope of coverage of this patent is not limited thereto. On the contrary, this patent covers all embodiments of the teachings of the invention fairly falling within the scope of the appended claims either literally or under the doctrine of equivalents.

DETAILED DESCRIPTION OF A PREFERRED EMBODIMENT

Figure 1:
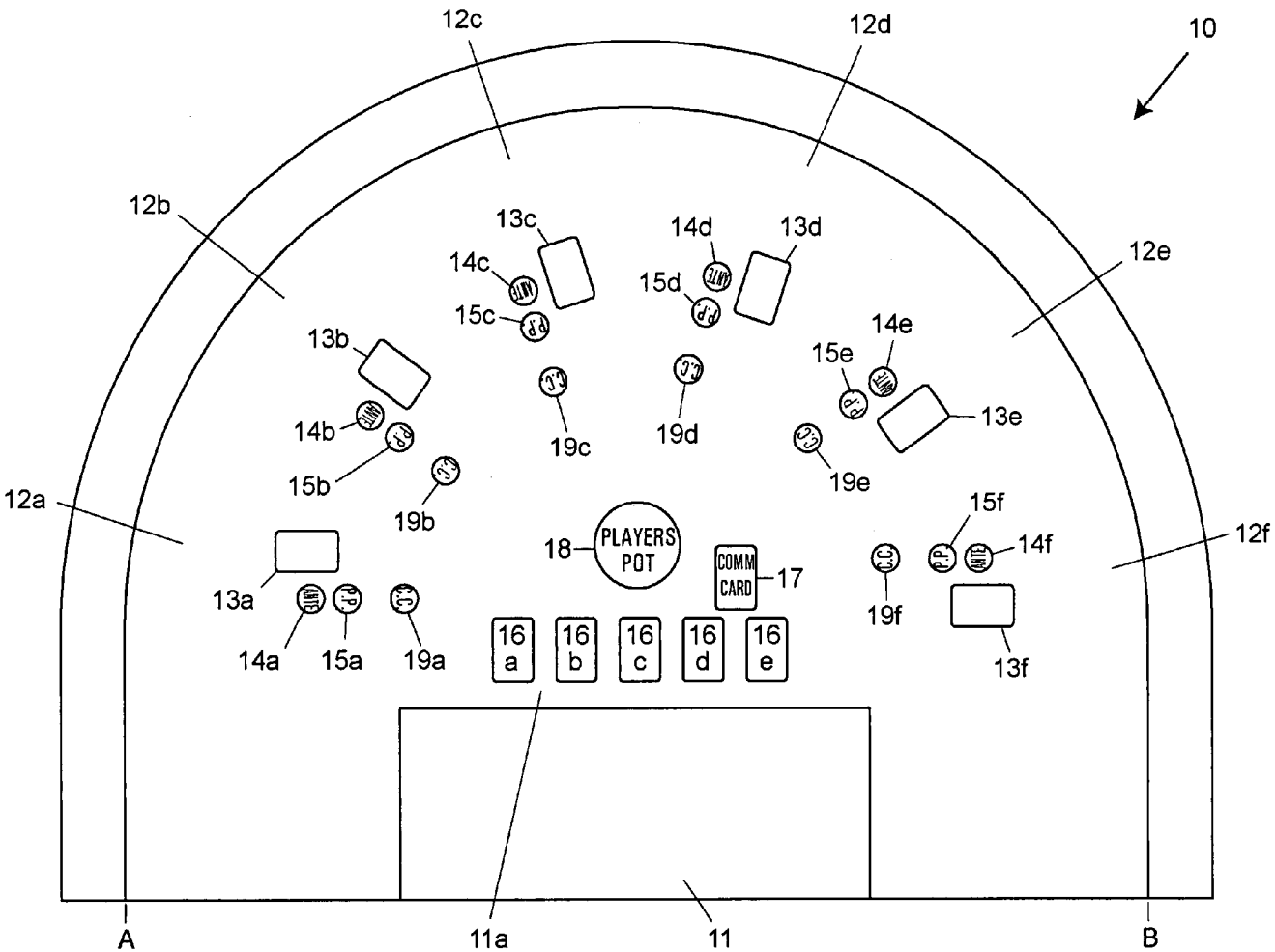
FIG. 1 is a plan view depicting a table which can be used for playing the casino poker game of the present invention.

Referring now to the drawing, FIG. 1 discloses a casino poker table at 10. Except for the legends on the surface, table 10 is structurally and dimensionally similar to a 76 inch blackjack table. That is, the distance between point A and point B is 76 inches. Table 10 has a generally semi-circular shape and is provided with a recessed area 11 where a dealer can stand and have access to the cards and wagers of the players around the table. Immediately in front of recessed area 11 is a dealer's playing station 11*a* where the dealer's cards can be dealt;

Six player areas or playing stations 12*a*, 12*b*, 12*c*, 12*d*, 12*e* and 12*f* are disposed along the arcuate side of table 10, across from dealer station 11*a*. Each player's station 12*a* through 12*f* has corresponding player's card playing areas 13*a* through 13*f*; first or ante betting zones 14*a* through 14*f*; second or Players Pot betting zones 15*a* through 15*f*; and players' common card betting zones 19*a* through 19*f*. The dealer contributes a set price, e.g., one dollar for the right to utilize the sixth card, and places that set price in a Players Pot zone 18. Betting zones 14 (ante), 15 (players pot) and 19 (common card) are defined by indicia (ante, p.p., and c.c., respectively) on the top of table 10.

In front of dealer's playing station 11*a* is a dealer's card area 16*a*, 16*b*, 16*c*, 16*d*, 16*e* for display of dealer's initial five cards, and a separate card area 17 for display of a sixth (common) card. The region in front of the dealer also contains the Players Pot zone 18 for holding chips or cash. Zone 18 could be labeled "Players Pot" (as shown) to indicate its function, and is the area where the dealer pays the pre-set fee for his utilization of the sixth card.

As described in the preceding paragraphs, play commences by each player placing an ante wager in the first betting zone 14 and second or Players Pot wager in betting zone 15. In one embodiment of the invention, the dealer then deals five cards to each of the players who has made an ante wager in zone 14 and a Players Pot wager in zone 15, placing five of the dealt cards in each player's card playing area 13. Cards are dealt from dealer's left to right, one-at-a-time. All cards, including those in dealer's area 16*a*, 16*b*, 16*c*, 16*d*, 16*e* and 17 are dealt in a face-down position. After inspection of his/her cards, a player may desire to improve his or her original hand by using the as yet unseen common card in location 17. A player wishing to use the common card places a predetermined percentage of his/her ante wager, that has been placed into zone 14, into his/her common card betting zone 19 (a predetermined percentage, e.g., 10% or 20%, of the players ante wager). In a preferred embodiment, the wagers in second betting zones 15*a*-15*f* would be moved by the dealer to Players Pot zone 18, after the dealer determines if he wishes to utilize the sixth card and if he does, places his common card cost, e.g., $0.50 or $1.00, into the Players Pot zone 18. The Players Pot zone 18 is where the dealer contributes his bet (or cost) for utilizing the sixth card.

Play commences by the dealer turning the dealer's five cards in areas 16*a*-16*e* to a face-up position. At this point the sixth card at location 17 is turned over, as are all of the players hands. All hands are left exposed.

The dealer's hand is compared with the hands of each of the players, in turn. If a player has a higher-value poker hand than the dealer, the wager at zone 14 will be returned to the player, together with an equal amount from the dealer. In one embodiment, if the player has a premium hand (as defined above), he or she will receive a bonus payment from the dealer. On the other hand, if a player's hand is lower in value than that of the dealer, the wager at zone 14 will be surrendered to the dealer.

Finally, the hands of each of the players will be compared and the funds in Players Pot zone 18 (optionally, less any house rake) will be awarded to the player having the highest value hand.

Although a preferred embodiment has been described in detail, it should be understood that various changes and alterations can be made without departing from the spirit and scope of the invention.

What is claimed is:

1. A method of playing a modified poker game comprising the following steps:

providing a table having a playing station for a dealer and playing stations for a plurality of players, each player station comprising a card playing area having first and second betting zones and a third zone;

each player placing an ante wager in said first betting zone and a second wager in said second betting zone, the players' second wagers comprising a Players Pot that is distributed only to the players;

the dealer paying a pre-set fee to the Players Pot on each deal for the privilege of using a sixth card;

the dealer dealing an initial, five-card hand, face down, to himself and to each player;

the dealer placing at least one sixth card on the table;

providing an opportunity for each player to utilize a sixth card, with each player that utilizes the sixth card paying a predetermined percentage of his ante wager to the third zone to utilize a sixth card;

turning all cards to a face up position:

(a) the dealer collecting the ante wagers in said first betting zone from each player whose poker hand is lower in value than the dealer's hand and the dealer collecting the payments made to the third zone;

(b) the dealer: i) returning the ante wager, and ii) paying an amount equal to the ante wager in said first betting zone to each player who has a higher poker hand than the dealer's hand; and (c) the dealer paying said Players Pot to the player having the highest poker hand on each deal.

2. The method of claim 1, wherein the amount of the dealer's payment is increased to a predetermined multiple of the ante wager for each player whose hand comprises a premium hand, provided that said premium hand comprises a higher poker hand than that of the dealer.

3. The method of claim 2 wherein said premium hand comprises three-of-a-kind or better.

4. The method of claim 3 wherein the multiple applied to the following types of poker hands is:

| | |
|---|---|
| Three of a Kind | 2 to 1 |
| Straight | 3 to 1 |
| Flush | 5 to 1 |
| Full House | 7 to 1 |
| Four of a Kind | 20 to 1 |
| Straight Flush | 125 to 1 |
| Royal Flush | 250 to 1. |

5. The method of claim 2 wherein said premium hand comprises a straight or better.

6. The method of claim 5 wherein the multiple applied to the following types of poker hands is:

| | |
|---|---|
| Straight | 3 to 1 |
| Flush | 5 to 1 |
| Full House | 7 to 1 |
| Four of a Kind | 20 to 1 |
| Straight Flush | 125 to 1 |
| Royal Flush | 250 to 1. |

7. The method of claim 2 wherein the predetermined multiple payment for a premium hand is based on the statistical rarity of said hand.

8. The method of claim 1 wherein a percentage of said Players Pot is retained by the house.

9. The method of claim 1 wherein each player's payment for use of the sixth card is 5% to 50% of the player's ante wager.

10. The method of claim 1 wherein each player's payment for use of the sixth card is boo to 10% to 20% of the player's ante wager.

11. The method of claim 1 wherein said sixth card is a single, common card for all players and the dealer, and is dealt face-down.

12. The method of claim 1 wherein the initial five card hands are dealt to each player five-at-a-time.

13. The method of claim 1 wherein the initial five card hands are dealt to each player one-at-a-time.

14. The method of claim 1 wherein said ante wager in said first betting zone is a whole-dollar amount in the range of five dollars to twenty-five dollars.

15. The method of claim 1, further including:

providing an opportunity for the dealer to utilize the sixth card by paying a set fee of $0.50 or $1.00 to the Players Pot.

16. The method of claim 1 wherein said table comprises a 76 inch black jack table.

* * * * *

UNITED STATES PATENT AND TRADEMARK OFFICE

CERTIFICATE OF CORRECTION

PATENT NO. : 7,360,766 B2
APPLICATION NO. : 11/208236
DATED : April 22, 2008
INVENTOR(S) : John E. Wirth It is certified that error appears in the above-identified patent and that said Letters Patent is hereby corrected as shown below:

At Column 8, line 48 claim 10, “is boo to 10%” should be -- is 10% --.

Signed and Sealed this

Seventh Day of October, 2008

JON W. DUDAS
*Director of the United States Patent and Trademark Office*